United States Patent [19]

Hayashi

[11] 4,349,110

[45] Sep. 14, 1982

[54] SIZE-REDUCIBLE CONTAINER

[75] Inventor: Masaho Hayashi, Tokyo, Japan

[73] Assignees: Dainippon Printing Co., Ltd.; Kanebo Foods, Ltd., both of Tokyo, Japan

[21] Appl. No.: 173,892

[22] Filed: Jul. 28, 1980

[30] Foreign Application Priority Data

Jul. 26, 1979 [JP] Japan ..... 54-103403[U]

[51] Int. Cl.[3] ..... B65D 5/54

[52] U.S. Cl. ..... 206/606

[58] Field of Search ..... 206/606, 627, 629

[56] References Cited

U.S. PATENT DOCUMENTS

| | | | |
|---|---|---|---|
| 760,310 | 5/1904 | Church . | |
| 1,171,462 | 2/1916 | Rice . | |
| 1,502,864 | 7/1924 | Milligan . | |
| 1,560,681 | 11/1925 | Fisher . | |
| 1,815,800 | 7/1931 | Respess . | |
| 1,939,794 | 12/1933 | Seybold | 229/87 |
| 2,039,830 | 5/1936 | Owens . | |
| 2,122,480 | 7/1938 | Lowey | 206/629 |
| 2,132,144 | 10/1938 | Blum . | |
| 2,176,768 | 10/1939 | Luchte . | |
| 2,179,504 | 11/1939 | Hasbrook . | |
| 2,251,283 | 8/1941 | Johnson | 229/37 |
| 2,279,831 | 4/1942 | Richardson . | |
| 2,447,096 | 8/1948 | Schneider . | |
| 2,490,133 | 12/1949 | Inman . | |
| 2,608,341 | 8/1952 | Eckman . | |
| 2,969,902 | 1/1961 | Cage | 229/4.5 |
| 3,086,692 | 4/1963 | Cage . | |
| 3,116,868 | 1/1964 | Lazure . | |
| 3,120,900 | 2/1964 | Faulstich | 206/606 |
| 3,137,437 | 6/1964 | Svensson . | |
| 3,167,238 | 7/1965 | Smith . | |
| 3,223,230 | 12/1965 | Branchi | 206/45.31 |
| 3,224,633 | 12/1965 | Allen | 221/48 |
| 3,235,167 | 2/1966 | Svensson . | |
| 3,281,059 | 10/1966 | Buttery . | |
| 3,302,855 | 2/1967 | Becker . | |
| 3,368,738 | 2/1968 | Roccaforte . | |
| 3,539,093 | 11/1970 | Massengill | 206/606 |
| 3,967,773 | 7/1976 | Kaufman | 206/606 |
| 4,091,929 | 5/1978 | Krane | 206/602 |

FOREIGN PATENT DOCUMENTS

| | | | |
|---|---|---|---|
| 48-77343 | 9/1973 | Japan . | |
| 48-77344 | 9/1973 | Japan . | |
| 48-77345 | 9/1973 | Japan . | |
| 50-40652 | 4/1975 | Japan . | |
| 50-78630 | 7/1975 | Japan . | |
| 50-97823 | 8/1975 | Japan . | |
| 51-30626 | 3/1976 | Japan . | |
| 51-132339 | 10/1976 | Japan . | |
| 51-141629 | 11/1976 | Japan . | |
| 51-49220 | 11/1976 | Japan . | |
| 52-54342 | 4/1977 | Japan . | |
| 52-95741 | 7/1977 | Japan . | |
| 53-77728 | 6/1978 | Japan . | |
| 54-14829 | 7/1979 | Japan . | |
| 54-14830 | 7/1979 | Japan . | |
| 54-67136 | 5/1979 | Japan . | |
| 54-67137 | 5/1979 | Japan . | |
| 59360 | 1/1937 | Norway | 206/627 |

*Primary Examiner*—Stephen P. Garbe

*Attorney, Agent, or Firm*—Cushman, Darby & Cushman

[57] ABSTRACT

A size-reducible rectangular tear-strip type rectangular column-like container for contents such as ice cream and margarine formed from a pre-patterned blank of a carton board, comprising: a plurality of spaced projecting gripping portions useful in tear-stripping respective sections which are contiguous to these gripping portions; a plurality of paired horizontally-extending and closely adjacent external and rear straight scored lines formed on both sides of the blank up to depths of about one half of the thickness of the blank, respectively. Adjacent respective pairs of the scored lines define sections of the container to be torn and stripped off from the remaining sections. Thus, this container, at the end of each consumption of the contents will reduce its size progressively for the convenience of storage.

3 Claims, 5 Drawing Figures

SIZE-REDUCIBLE CONTAINER

BACKGROUND OF THE INVENTION (a) Field of the Invention

The present invention pertains to a container for accommodating a mass of cake such as icecream or margarine. More particularly, the present invention relates to a size-reducible container whose size can be reduced stepwise easily as the mass of cake contained therein reduces its volume in accordance with its progressive stepwise consumption or dispensing by the user, so that unnecessary space for the storage of the container is eliminated accordingly for the convenience of storage in a place like the interior of a refrigerator.

(b) Description of the Prior Art

Icecream packages or containers designed for household use are, in general, provided in either cup style, cylindrical style or box style of about 500 ml to 1,000 ml in volume. These known containers are such that, after a required amount of the contents such as icecream is consumed, the remaining portion of icecream now having a reduced volume is left in the container to be kept in, for example, a refrigerator. Thus, the remaining portion of icecream, in fact, occupies only a part of the volume of the container. However, since the container as a whole is stored in the refrigerator, there is the inconvenience that an unnecessary section of the container, i.e. that portion thereof which is not filled with the contents, has to be placed in the refrigerator for storage purposes. In this sense, especially a cup-style container of a frusto-conical shape has the inconvenience that the space-utility in a storage area is poor because of its configuration. These inconveniences of the known containers are encountered not only in the storage of such known containers in, for example, refrigerators, but also in case of display of similar articles on the shelves of a food store.

On the other hand, there has been developed and placed on the market a foodstuff container having a full-deep tear-strip scored lines formed on the surfaces of the container so that those portions of the container which have become empty due to consumption of the contents are torn and removed, to keep the container now having a reduced size in a storage space. In case, however, containers having a scored lines are used for the purpose of storage of such food as icecream or margarine, there would occur a mishap that the icecream contained in the container exudes to the outside of the container through the scored lines. Furthermore, such known container having scored lines is again not desirable from the aspects of appearance, hygiene, and mechanical strength of the container itself.

SUMMARY OF THE INVENTION

It is, therefore, an object of the present invention to provide a size-reducible container whose volume can be reduced correspondingly to the stepwise consumption of the contents such as icecream or margarine which have been tightly filled in the container, to thereby eliminate unnecessary space in a storage area which the container, otherwise, would occupy during storage.

Another object of the present invention is to provide a container as described above, which allows stepwise reduction of its volume or size to be performed with ease, without being accompanied by a leakage of the contents to the outer surfaces of the container.

Still another object of the present invention is to provide a container of the type described above, which is hygienic and is easy to handle.

A further object of the present invention is to provide a container of the type described above, which can be manufactured at a low cost.

A still further object of the present invention is to provide a container of the type described above, which has adjacent portions that can be torn and stripped away, one portion after another.

A yet further object of the present invention is to provide a container of the type described above, which is easy to fill contents such as icecream or margarine in the container at the time of packaging.

Figure 1:
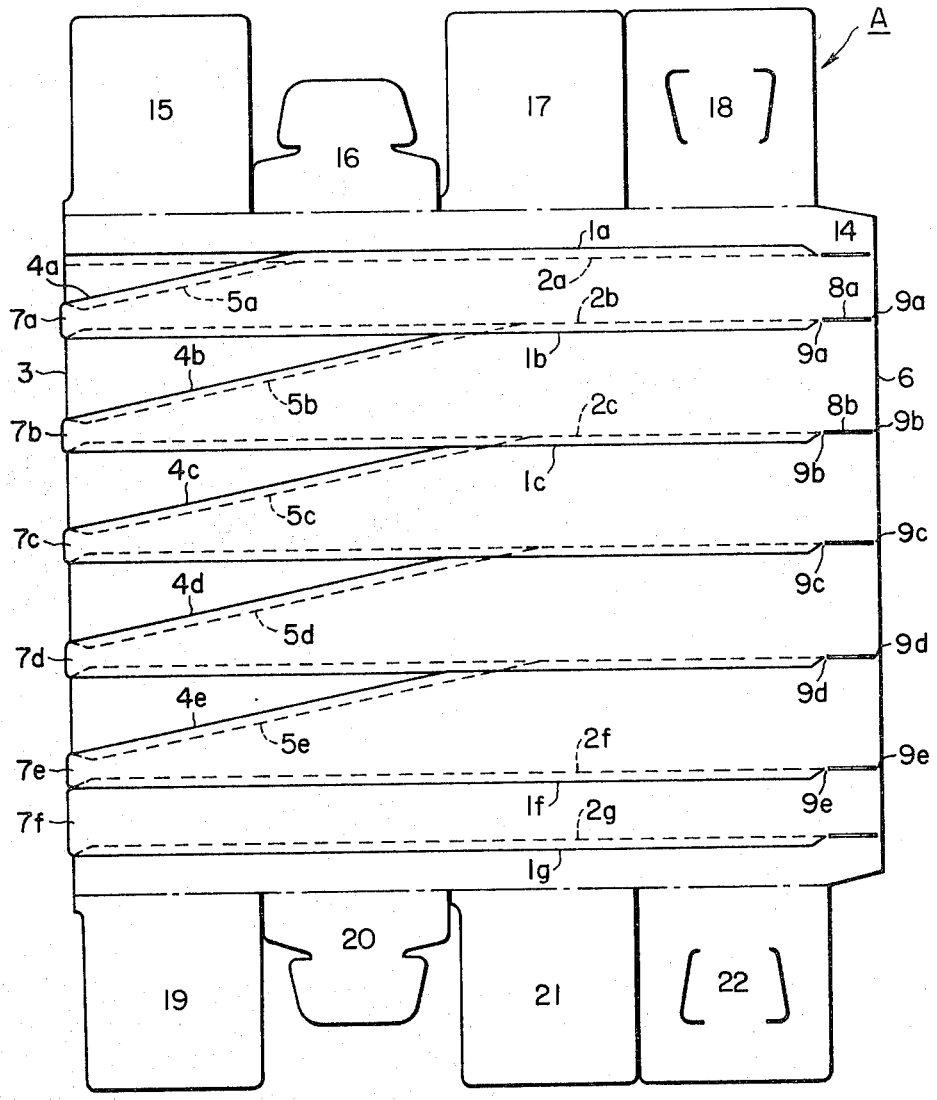
FIG. 1 is a diagrammatic plan view of an opened blank of the carton board for use in the present invention.

FIG. is a diagrammatic perspective view of the container in its assembled form by the use of the blank shown in FIG. 1, and a perspective view of a cap member for the container.

Figure 2:
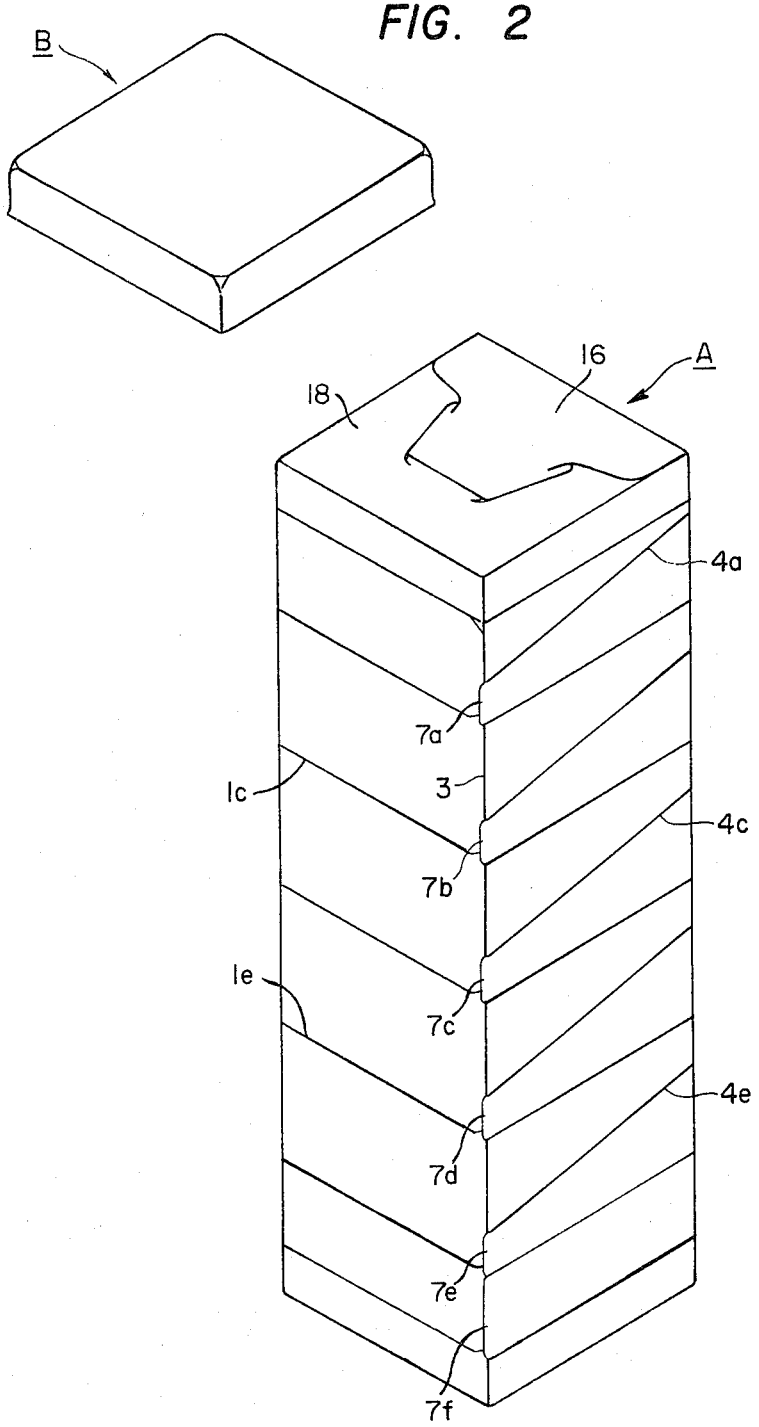
Figure 3:
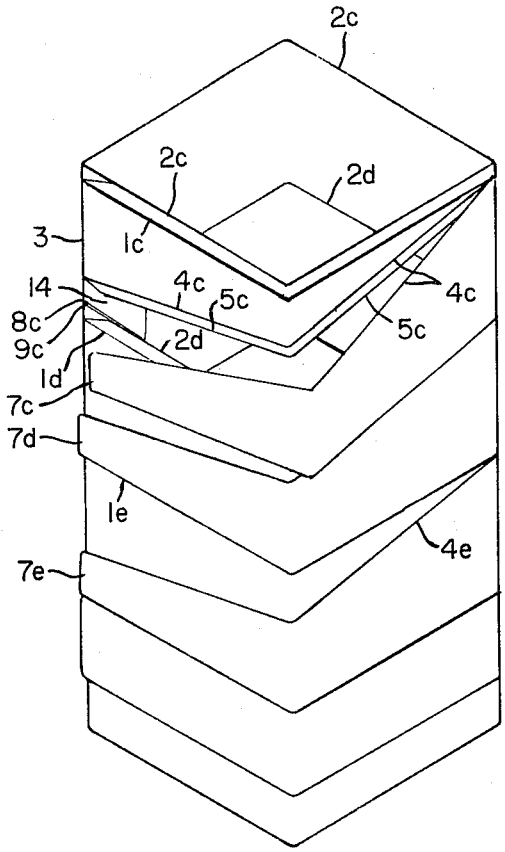

FIG. 3 is a diagrammatic perspective view of the container of FIG. 2 during its use.

Figure 4:
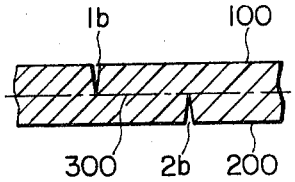

FIG. 4 is a diagrammatic explanatory illustration, on an enlarged scale, of a portion of the carton board of the container shown in FIG. 2 having half-deep score lines formed at both surfaces of this carton board to a depth of about one half of the thickness of the wall, respectively.

Figure 5:
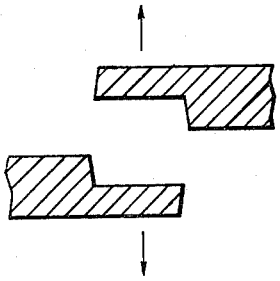

FIG. 5 is a diagrammatic explanatory illustration, on an enlarged scale, showing the state in which the same portion of the carton board shown in FIG. 4 is torn and stripped away into two parts at the tear-strip half-scored lines formed at both surfaces of the wall of the container.

Like parts are indicated by like reference numerals and symbols throughout the drawings.

In this specification, the words "half-deep scored line" and "half-scored line" point to a same kind of tear-strip line.

DETAILED DESCRIPTION OF A PREFERRED EMBODIMENT

FIG. 1 shows a diagrammatic plan view of the outer side of a blank before being assembled into a container according to the present invention. This blank is made of a sheet of carton board. In FIG. 1, numeral 14 represents an adhesive flap. Numerals 15, 16, 17 and 18 represent cover panels, respectively. Numerals 19, 20, 21 and 22 represent bottom panels, respectively. Numerals 1*a* and 2*a*, 1*b* and 2*b*, . . . represent horizontally-extending half-deep tear-strip scored lines which are aligned in parallel with each other, forming a pair. Numeral 3 represents an end edge of the blank. Numerals 4*a* and 5*a*, 4*b* and 5*b*, . . . represent obliquely-extending half-deep tear-strip scored lines which are aligned in parallel with each other forming a pair. Numeral 6 represents an edge of the adhesive flap 14. Numerals 7*a*, 7*b*, . . . represent gripping portions. Numerals 8*a*, 8*b*, . . . represent slits formed through the adhesive flap 14. Numerals 9*a*, 9*b*, . . . represent connecting regions of the adhesive flap 14 left at opposite ends of the slits 8*a*, 8*b*, . . . .

Description will hereunder be made of the half-deep tear-strip scored lines. In FIG. 4, the horizontally extending half-deep tear-strip scored lines 1*b* is a linear line such that the depth of cut extends up to about one half of the thickness of the carton board starting at its external surface 100. Another horizontal similar scored lines 2b is formed so as to have a depth of cut extending to about one half of the thickness of this carton board starting at the rear surface 200 of this board. These two horizontal half-scored lines are provided in parallel with each other, making a pair at a close distance of, for example, 1 to 5 mm. Thus, when a section of the board bearing these two half-scored lines 1c and 2c in FIG. 1 is torn by nipping, for example, the gripping portion 7b, and then by pulling this gripping portion away from the remaining sections of the assembled carton box, there is applied a pulling force to the external surface portion bearing the external half-scored line 1c, and concurrently therewith there is applied a pulling force to the rear side of the similar portion bearing the inner half-scored line 2c. Therefore, the intermediate region shown at 300 in FIG. 4 is torn away in the directions of arrows and in a manner as shown in FIG. 5, so that there is caused a detachment of the carton board between the external surface 100 and rear surface 200. Thus, the portion of the carton box bearing the gripping portion 7b and defined by the scored lines 1b, 2b and 1c, 2c is removed progressively from the remaining sections of this carton box. Therefore, a fresh part of the contents can be exposed at the top of the now-opened end of this box for access thereto by the user.

The above-described principle of the present invention applies to the oblique half-scored lines 4a, 5a. . . . By pulling the carton board at a gripping portion, for example, at 7b, the section of the carton board containing these oblique half-scored lines 4b and 5b is stripped away from the remaining sections of this box or container.

It should be noted that each of the horizontally-extending external half-scored lines 1a, 1b, 1c . . . 1g of the respective pairs are provided in parallel and in closely adjacent relation with their mating rear-side half-scored lines 2a, 2b, 2c . . . 2g of the pairs, respectively.

The oblique half-scored lines are provided for facilitating easy tear-stripping of any particular section of the carton board which is to be removed.

In FIG. 1, that bottom section of the carton board locating between the horizontal half-scored lines 1f and 2g is not provided with obliquely-extending half-scored lines. This is because of the fact that this particular section of the carton box has a reduced width as compared with the other respective sections which are to be cut off or removed. Thus, there practically is no need to provide the oblique scored lines so as to facilitate an easy tear-stripping of this bottom section of the container or carton box. Accordingly, it will be understood that, in the present invention which features the half-depth scored lines formed oppositely in the thickness of the carton board, the provision of the obliquely-extending half-scored lines is not always necessary if each section of the container defined between the upper and lower horizontally-extending half-scored paired lines is given a relatively small width. However, the provision of the obliqud half-scored lines is useful in giving the user an ease in tear-stripping the respective sections of the container made with a carton board.

Each of the gripping portions 7a, 7b, . . . is formed so as to project beyond the end edge 3 of the container for a very small distance sufficient for facilitating the nipping of this gripping portion by the user's fingers.

The connecting regions 9a, 9a, 9b, 9b, . . . 9f, 9f are provided so that those connecting portions located at the outer edge portions of the carton box in FIG. 1 serve to retain the entity of the adhesive portion 14 of the carton board. In case those connecting regions 9a, 9b, . . . 9f which are formed at the outer edge portion of the adhesive flap 14 are absent, and in case the slits 8a, . . . 8f extend up to the very outer edge of the carton board, the respective sections of the carton board defined between the respective adjacent slits 8a, . . . 8f will be rendered to become respective free pieces, which will cause an inconvenience that when the adhesive flap 14 is to be bonded to the inner surface of the other end portion of the carton board, these free pieces troublesomely will have to be bonded one after another to the inner surface of the other end portion of the carton board. Also, those narrow connecting regions located away from said outer edge of the adhesive flap 14 give the convenience to facilitate the bending of the adhesive flap 14 vertically along these vertically adjacent connecting regions 9a, . . . 9f when the board is assembled together into a box style.

It should be understood also that the size-reducible container according to the present invention is intended for such foodstuffs as icecream and margarine, and that therefore it is desirable to have the entire inner surface of the blank of the container lined or laminated with a thin film of a synthetic resin such as polyethylene having a damp-proofing ability, depending on the nature of the contents to be filled in the container A. In FIG. 2, there is shown a cap member B which is made of a plastics material formed through a known vacuum-molding technique. This cap member B is of a size so as to conform to the outer configuration and the size of the container A and to fit snugly on the exposed top section of this container A. This cap member B will cover the entire exposed portion of the contents in case any section of the container is cut away, to provide hygiene for the contents.

In case a rectangular columnar container according to the present invention is assembled from the blank shown in FIG. 1, the adhesive flap 14 is caused to adhere to the inner or rear surface of the opposite side of the blank to form a column, in such way that the gripping portions 7a, . . . 7f will protrude for a sufficient distance beyond a longitudinal corner of the box-like container. Then, the bottom panels 19, 20, 21 and 22 are bent to form a closure. Thereafter, molten icecream composition or margarine is poured into the container through an opening formed by the cover panels 15, 16, 17 and 18. When the container is filled with the molten contents, the cover panels 15, 16, 17 and 18 are bent to form a closure, and the cap member B is applied to an end of this closed columnar box, and the resulting container is cooled or frozen to consolidate the contents. The resulting container A with the applied cap member B is ready for being sold commercially.

In case a person who has purchased this container intends to use it to get access to its contents, the user removes the cap member B off the container A, and nips, between his fingers, one of the gripping portions 7a, . . . 7f, and pulls this portion horizontally in the direction away from the protruding edge of the gripping portion, for example, at 7b. Whereupon, those regions of the carton board located between the oblique tear-strip lines, for example, 4a and 5a and then those regions located between the horizontal tear-strip lines, for example, 1a, 2a and 1b, 2b are progressively peeled off in this order at the half-deep front and rear scored lines of the carton board. Thus, the then top-positioned portion of the container A is removed, and the contents which, till then, have been enclosed in said portion are exposed for use. After this, the cap member B is applied to the remaining top portion of the container ready for storage.

As stated above, the container of the present invention may be handled so that the removal of the respective sections of the container box is done, starting at the top section of this container shown in FIG. 2, or alternatively at the bottom section thereof, or at any intermediate section thereof, as desired.

In the known packages or containers for containing margarine or icecream, there is no container having a combination of the oblique and horizontal paired half-deep scored lines provided on both sides of a single carton board.

What is claimed is:

1. A size-reducible rectangular box-like columnar container made from a pre-patterned blank of a carton board exposing its outer side and having a mating cap member, comprising:

a plurality of spaced first horizontal tear-strip scored straight lines formed on the outer surface of said carton board to extend from one edge of said blank horizontally along the entire circumference of said container and to a depth of about one half of the thickness of said carton board;

a plurality of spaced second horizontal tear-strip scored straight lines formed on the inner surface of said carton board to extend from said one edge of said blank horizontally along the entire circumference of said container parallel to said first scored lines but in spaced relation thereto and to a depth of about one-half of the thickness of said carton board, said scored lines being arranged in pairs of one outer line and one inner line located close to each other to provide an easy tear-strip means for each section of said container defined by adjacent of said pairs;

a plurality of separate gripping end portions, for being nipped by a user, formed along said one edge of blank between adjacent of said pairs and all protruding beyond a longitudinal corner line of the outer side of said container; and a flap portion formed along the edge of said blank opposite said one edge and secured adhesively to the inner surface of the marginal portion of said one edge at said corner line, said flap portion having slits therein aligned with but spaced from the lines of each of said pairs and terminating short of said opposite edge to thereby provide connecting portions at the opposite ends of said slits that maintain integrity of said flap portion while facilitating sections thereof to be torn off with said tear-strip means.

2. A container according to claim 1 in which a plurality of the gripping portions are of less width than their corresponding sections and including:

a plurality of spaced first oblique tear-strip scored lines formed on the outer surface of the carton board up to a depth of about one-half of the thickness of said board and extending obliquely from respective said gripping portions to join the first horizontal tear-strip scored lines; and a plurality of spaced second oblique tear-strip scored lines formed on the inner surface of said board up to a depth of about one-half of the thickness of said board and extending obliquely from respective said gripping portions to join said second horizontal tear-strip scored lines, said obliquely extending scored lines being arranged in pairs of one outer and one inner line located close to each other to facilitate the tearing off of a corresponding section of said container.

3. A size-reducible rectangular box-like columnar container according to claim 2, in which:

a tear-strip section of the container defined between the bottom pair of the horizontal scored lines and its adjacent pair of the horizontal scored lines has a width smaller than other sections defined between respective other pairs of horizontal scored lines, and said bottom section is devoid of oblique scored lines.

* * * * *